US009357616B2

(12) United States Patent
Prakash

(10) Patent No.: US 9,357,616 B2
(45) Date of Patent: May 31, 2016

(54) PATIENT MONITORING DEVICE FOR DISPLAYING MEDICAL IMAGE FILM

(71) Applicant: GENERAL ELECTRIC COMPANY, Schenectady, NY (US)

(72) Inventor: Ajay Prakash, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 278 days.

(21) Appl. No.: 13/924,230

(22) Filed: Jun. 21, 2013

(65) Prior Publication Data

US 2014/0001981 A1 Jan. 2, 2014

(30) Foreign Application Priority Data

Jun. 29, 2012 (IN) ..... 2599/CHE/2012

(51) Int. Cl.

| | |
|---|---|
| ***H05B 37/02*** | (2006.01) |
| ***G09F 13/04*** | (2006.01) |
| ***G09G 3/34*** | (2006.01) |

(52) U.S. Cl.

CPC ..... *H05B 37/0209* (2013.01); *G09F 13/04* (2013.01); *G09G 3/342* (2013.01); *G09G 2320/0606* (2013.01); *G09G 2320/0626* (2013.01)

(58) Field of Classification Search

CPC ..... H03B 37/0209; G09F 13/04
USPC ..... 315/312; 345/77, 102, 89, 108; 40/361–367, 77, 102, 89
See application file for complete search history.

(56) References Cited

U.S. PATENT DOCUMENTS

| | | | | |
|---|---|---|---|---|
| 6,269,565 | B1 * | 8/2001 | Inbar et al. | 40/361 |
| 7,202,838 | B2 * | 4/2007 | Kerr | G06F 19/321 345/1.2 |
| 7,710,387 | B2 * | 5/2010 | Yamaguchi | 345/102 |
| 2002/0039084 | A1 * | 4/2002 | Yamaguchi | 345/1.1 |

* cited by examiner

*Primary Examiner* — Dinh T Le
(74) *Attorney, Agent, or Firm* — GE Patent Global Organization; Marc A. Vivenzio

(57) ABSTRACT

A patient monitoring device comprising a display unit comprising a plurality of light sources, wherein the plurality of light sources is configured to backlight a medical image film placed on the display unit for viewing the medical image film, and a control unit configured to activate the plurality of light sources based on a user input.

15 Claims, 5 Drawing Sheets

PATIENT MONITORING DEVICE FOR DISPLAYING MEDICAL IMAGE FILM

TECHNICAL FIELD

Embodiments of the present invention relate to displaying medical image films. More specifically, the subject matter relates to a patient monitoring device for displaying a medical image film.

BACKGROUND OF THE INVENTION

Medical image films such as analog medical images are commonly used by medical experts for diagnosing the health condition of a patient. The medical image films may be taken for different body parts of the patient that requires examination. Different kinds of medical image films may be generated such as, radiography films, magnetic resonance imaging (MRI) films, X-ray films, fluoroscopy reports, mammography analog reports, ultrasound films and positron emission tomography (PET) films.

A medical image film may be diagnosed or viewed by a medical expert by placing on a display screen that lights the medical image film from the back. Once lighted, details of a body part displayed in the medical image film can be viewed. Then health condition of the patient can be explained to concerned individuals or the patient. However, at times the patient may not be able to move from a current location to another location where the display screen is placed. For example, a patient may be connected to different patient monitoring systems in a room. A display screen for displaying a medical image film may be present in a different room. Since the patient is connected to the patient monitoring systems and due to the patient's health condition, the patient may not be able to move from the patient's current location. As a result, the medical expert may not be able to explain the medical image film in the presence of the patient. In cases where the medical expert needs to explain the medical image film, the display screen needs to be shifted to the patient's location, which is cumbersome.

Therefore, there is a need for a system for displaying medical image films near to a bedside of a patient or a current location of the patient.

BRIEF DESCRIPTION OF THE INVENTION

The above-mentioned shortcomings, disadvantages and problems are addressed herein which will be understood by reading and understanding the following specification.

As discussed in detail below, embodiments of the present invention comprise a patient monitoring device configured to display a medical image film. The patient monitoring device comprises a display unit having multiple light sources. The light sources configure the display unit for backlighting the medical image film placed on the display unit. The medical image film is backlighted for viewing. The light sources may be activated based on a user input received at a control unit.

In an embodiment of the present invention, a control unit for operating the patient monitoring device is disclosed. The patient monitoring device displays health parameters of a patient. The control unit comprises a processor that is configured to receive an input upon positioning a medical image film on a display unit of the patient monitoring device. In an embodiment of the present invention, a plurality of light sources is configured to backlight the display unit for displaying the medical image film in response to receiving the input.

In an embodiment of the present invention, a method for displaying a medical image film on a display unit of a patient monitoring device is disclosed. The method comprises receiving an input upon positioning the medical image film. In response to the received input, the plurality of light sources is configured to backlight the display unit for displaying the medical image film. Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part hereof, and in which is shown by way of illustration embodiments of the present invention that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the present invention.

In an embodiment of the present invention, a patient monitoring device for displaying a medical image film is disclosed. The patient monitoring device comprises a display unit having multiple light sources. The light sources configure the display unit for backlighting the medical image film placed on the display unit. The medical image film is backlighted for viewing. The light sources may be activated based on a user input received at a control unit.

Figure 1:
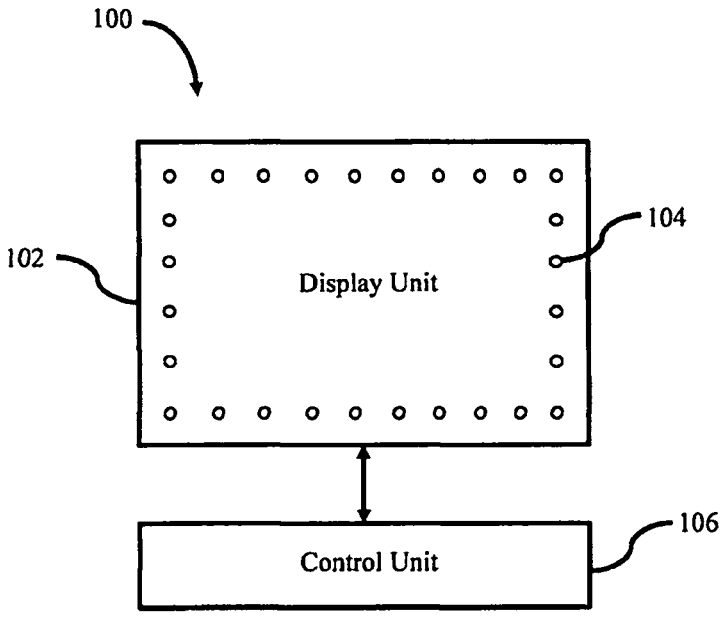
FIG. 1 is a schematic illustration of a patient monitoring device for displaying a medical image film in accordance with an embodiment of the present invention.

FIG. 1 is a schematic illustration of a patient monitoring device 100 for displaying a medical image film in accordance with an embodiment of the present invention. The patient monitoring device 100 comprises a display unit 102 displaying health parameters of a patient. The patient monitoring device 100 may be placed close to the patient. The health parameters and their parameter values are displayed so that health condition of the patient can be continuously monitored. The health parameters may include but are not limited to, blood pressure, pulse pressure, body temperature, heart rate, neurological activities, respiratory frequencies, saturated percentage of oxygen in the blood (Sp02), carbon dioxide measurement, cardiac output, end-tidal carbon dioxide concentration (EtCO2) and airway respiratory rate (AWRR). The patient monitoring device 100 may be configured to display a medical image film. The parameter values for these health parameters and corresponding waveforms may also be displayed in the display unit 102. The medical image film to be displayed may be an analog film that may be visible when lighting, for example, a white light background may be provided from the back. The medical image film may include but is not limited to, a radiography film, a magnetic resonance imaging (MRI) film, an X-ray film, a fluoroscopy report, a mammography analog report, an ultrasound film, a spine scan report and a positron emission tomography (PET) film. The medical image film may be an analog image of a patient's body part. For example, the medical image film may be of a fractured limb of the patient. The medical image film may be available in different standard sizes. The medical image film may be, for example, but is not limited to following sizes: 14×17 inches (in); 7×17 in; 10×12 in; 8×10 in; 11×14 in; 18×24 cm; 24×24 cm; and 24×30 cm.

The display unit 102 comprises multiple light sources, such as a light source 104, that provide light to the medical image film placed on the display unit 102. More specifically, when the medical image film is placed on the display unit 102 a control unit 106 activates the light sources to illuminate or light the medical image film from the back. The control unit 106 activates upon receiving a user input such as, such as a user input generated by a pressing of a switch of the patient monitoring device 100. For instance, a user may place the medical image film on the display unit 102 and then press the switch present in the display unit 102 for activating the light sources. Once the light sources are activated, the display unit 102 may act as a normal display screen used for displaying the medical image film. The light sources may include Light Emitting Diodes (LEDs) or any other light sources. The light provided may be a white light. Further, these light sources may have high intensity for providing adequate light for illuminating the medical image film. The light sources may have different light intensities. In an embodiment of the present invention, the intensity of light sources may be varied based on user input and the intensity may be controlled by the control unit 106. The user input may be a manual input. The light sources may be placed along a periphery of the display unit 102 as illustrated in FIG. 1. As the light sources are placed in the periphery, they can illuminate the display unit 102 uniformly. However, the light sources can be placed in any other position for enabling them to provide uniform lighting to the medical image film. In an embodiment of the present invention, the light sources may be arranged based on a size of the display unit 102. The display unit 102 may have different sizes, for example, a 19 inch display screen and a 20 inch display screen. The display unit 102 may be, but is not limited to, a touch screen display unit, a Liquid Crystal Display (LCD) display unit or any other display units. The medical image film displayed on the display unit 102 may be shown to a patient and explained by a medical expert, such as a doctor. As the patient monitoring device 100 is placed close to the patient or in the same location as the patient, the medical image film can be conveniently displayed and explained to the patient without moving the patient from one location to another.

When the display unit 102 displays the medical image film, the patient monitoring device 100 may be configured to display the health parameters of the patient. The patient monitoring device 100 may be capable of operating in two modes such as, a monitoring mode and an image film display mode. Moreover, the patient monitoring device 100 may dynamically shift between these two modes of operation thereby facilitating the use of the patient monitoring device 100 for these dual purposes with convenience.

Figure 2:
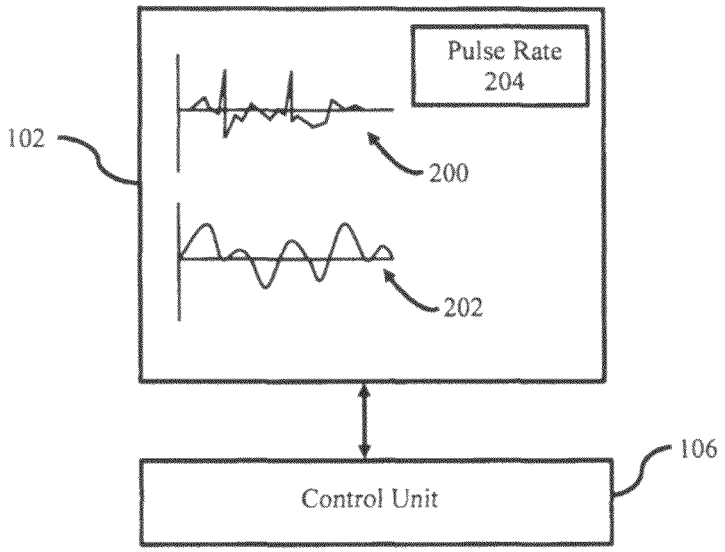
FIG. 2 is a schematic illustration of a patient monitoring device operating in the monitoring mode in accordance with an embodiment of the present invention.

FIG. 2 is a schematic illustration of the patient monitoring device 100 operating in the monitoring mode, in accordance with an embodiment of the present invention. In the monitoring mode, the display unit 102 displays the health parameters of the patient. The health parameters may be displayed in the form of waveforms such as, a heart rate waveform 200 and/or a respiratory rate waveform 202. These waveforms indicate the variation in the heart rate and the respiratory rate of the patient to indicate a health condition of the patient at different instances. In addition, other health parameter values such as pulse rate 204 may be displayed in the display unit 102. Similarly, parameter values and waveforms of other health parameters may also be displayed in the display unit 102. The health parameter information may be obtained from medical devices connected to the patient monitoring device 100. Numerous medical devices may be connected to the patient's body based on one or more health conditions, and the health parameters values monitored by these medical devices may be displayed on the display unit 102. Occasionally, a medical expert may check the health parameters for any variation in the health parameters beyond their corresponding thresholds. In an embodiment of the present invention, the patient monitoring device 100 may have the capability of generating alarm inputs to the medical experts when there is a variation in health parameters. The control unit 106 may control the operation of the patient monitoring device 100 in the monitoring mode. The control unit 106 may shift the patient monitoring device 100 to the image film display mode when the medical image film needs to be displayed. Shifting from the image film display mode to the monitoring mode may occur when an alarm input is received. The alarm input may be associated with the health parameters of the patient.

In accordance with an embodiment of the present invention, a patient may have a sudden variation in one or more health conditions such as a change in heart rate which may generate an alarm input. In response, the patient monitoring device 100 automatically shifts to the monitoring mode for displaying the heart rate and corresponding heart rate waveform to a medical expert. This alarm input also provides indication to the medical expert to remove the medical image film from the display unit 102. In accordance with an embodiment of the present invention, based on the alarm input, the medical expert may be notified to remove the medical image film from the display unit 102. This may prompt the medical expert to provide an input manually to shift to the monitoring mode.

Figure 3:
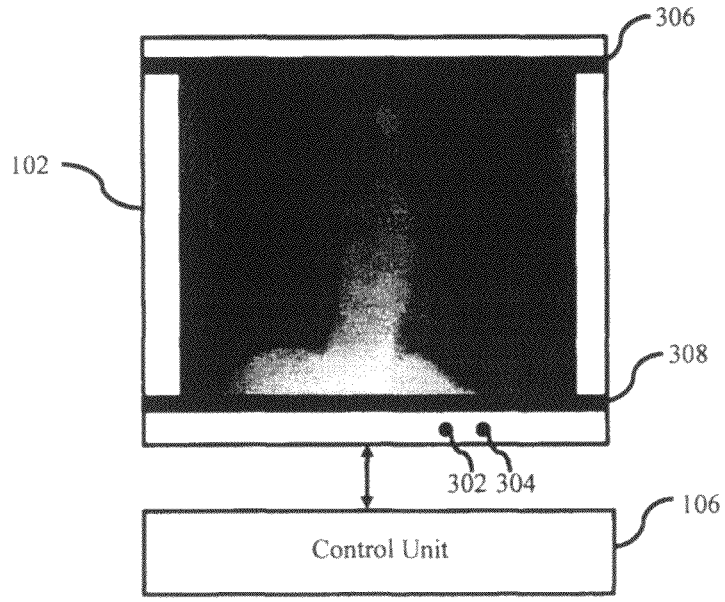
FIG. 3 is a schematic illustration of a patient monitoring device operating in the image film display mode in accordance with an embodiment of the present invention.

FIG. 3 is a schematic illustration of the patient monitoring device 100 operating in the image film display mode in accordance with an embodiment of the present invention. A user such as the medical expert may place a medical image film 300 on the display unit 102. The medical expert may submit an input by pressing the switch. The switch may be a hardware switch present in the patient monitoring device or a user interface element present in a display screen of the display unit 102. The display screen may be a touch display screen or any other display screen. In an embodiment of the present invention, the input may be submitted first and thereafter the medical image film 300 may be placed on the display unit 102. The control unit 106 may present instructions for assisting the medical expert in positioning the medical image film 300 on the display unit 102. The instructions may vary based on a size and a type of the medical image film 300. The size and the type of the medical image film 300 may be manually entered. In an embodiment of the present invention, the size of the medical image film 300 may be identified upon positioning the medical image film 300 on the display unit 102. In this case, sensors may be present in the display unit 102 for identifying the size of the medical image film.

In response to receiving the input the control unit 106 configures the patient monitoring device 100 in the image film display mode. In an embodiment of the present invention, the patient monitoring device 100 may identify the presence of the medical image film 300 on the display unit 102 and automatically configure itself in or switch to the image film display mode. In this embodiment of the present invention, multiple sensors that sense the presence of the medical image film 300 and communicate with the control unit 106 may be present in the display unit 102. In an embodiment of the present invention, the control unit 106 receives this communication and performs a check to determine if there is any alarm input(s) associated with health condition of the patient. If any alarm input(s) is/are present, the control unit 106 does not accept the placement of the medical image film. The user may be prompted to remove the medical image film. In an embodiment of the present invention, the user may be prompted by activating an indicator element 302 for example a red light indicator. However, if there is/are no alarm input(s), the control unit 600 provides indication that the placement of the medical image film is accepted by lighting an indicator element 304, for example a green light indicator. In an embodiment of the present invention, the control unit 106 may present instructions through the display unit 102 to the user to remove the medical image film or accept placement of the medical image film. In an embodiment of the present invention, the instructions may be communicated to the user via a sound indicator. However, it may be envisioned that other embodiments may employ various other techniques for presenting these instructions to the user.

In an embodiment of the present invention, once the medical image film placement is accepted, the patient monitoring device 100 is configured in the image film display mode. In this mode, the control unit 106 activates the light sources to configure the display unit 102 to have a white background light. Consequently, the medical image film 300 may be lighted from the back so that an image present in the medical image film 300 may be displayed. For example, an image of a fractured limb of a patient may be placed on a display unit configured in the image film display mode. The light sources present in the display unit facilitates in showing fractures present in the limb.

The medical image film 300 needs to be positioned securely on the display unit 102 and thus manually holding the medical image film 300 is cumbersome. In an embodiment of the present invention, multiple holding members are provided on the display unit 102 for holding the medical image film 300. The holding members may include but are not limited to, a clip and a long clip member. As illustrated in FIG. 3, the display unit 102 may have two multiple holding members such as, a holding member 306 and a holding member 308. These holding members hold the medical image film 300 on the display unit 102. The holding members may be connected to the display unit 102 for example along a periphery of the display unit 102. In an embodiment of the present invention, a holding member may be removably connected to the display unit 102. In an embodiment of the present invention, a position of a holding member may be varied by moving the holding member with respect to the display unit 102. In an embodiment of the present invention, the display unit 102 may comprise a mechanism such as a sliding mechanism for connecting the holding member to the display unit 102. The sliding mechanism may be provided so that the position of the holding member can be varied conveniently. However, it is contemplated that other embodiments may include various other mechanisms for positioning the holding member. The position of the holding members 304 may be varied based on the size and position of the medical image film 300 on the display unit 102. In an embodiment of the present invention, the control unit 106 may present instructions to the medical expert for positioning the holding members 306 and 308 through the display unit 102. The instructions for positioning the holding members 306 and 308 may vary depending on the size and position of the medical image film 300.

Figure 4:
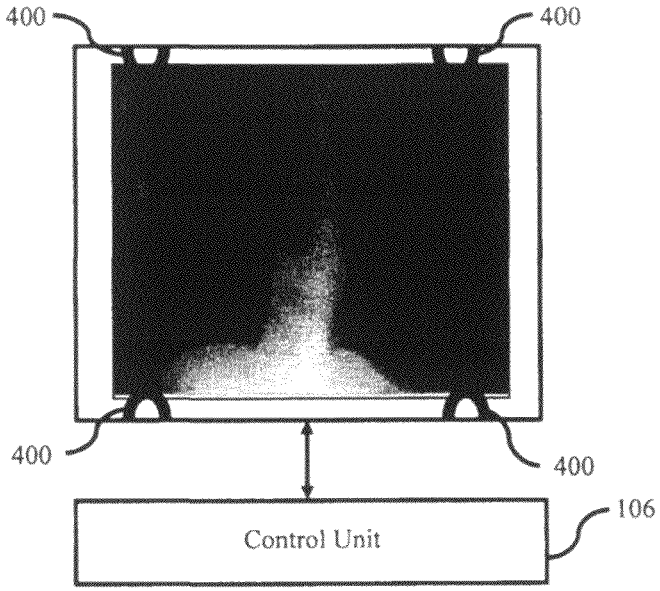
FIG. 4 is a schematic illustration of holding members for holding a medical image film positioned on a display unit of a patient monitoring device in accordance with an embodiment of the present invention.

In an embodiment of the present invention, the holding members may be clips 400 that may be placed on top of the medical image film 300 positioned on the display unit 102 as illustrated in FIG. 4. The position of the clips 400 may be varied. The clips 400 may be moved from one position to another on the display unit 102 manually by a user. The position of the clips 400 are varied based on the size and position of the medical image film 300 on the display unit 102. The medical expert may be presented with instructions by the control unit 106 for positioning the clips 400 on the display unit 102. The holding members as shown in FIG. 3 and FIG. 4 are illustrative configurations and thus holding members having other configurations may be used for holding the medical image film 300 on to the display unit 102.

Figure 5:
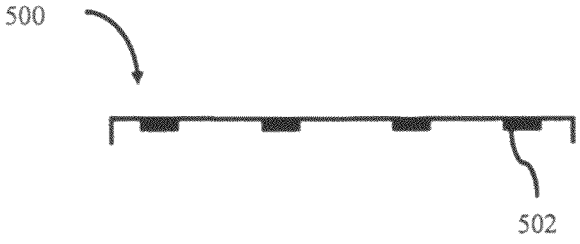
FIG. 5 is a schematic illustration of a holding member for holding a medical image film in accordance with an embodiment of the present invention.

FIG. 5 is a schematic illustration of a holding member 500 for holding a medical image film in accordance with an embodiment of the present invention. The holding member 500 comprises multiple sensors arranged along its length as illustrated. The arrangement of the sensors present in the holding member 500 is but one configuration and thus the sensors may be configured in the holding member 500 in any other manner. The sensors may include, but are not limited to, infrared (IR) sensors, position sensors, presence sensors, capacitive sensors, inductive sensors, acoustic sensors and proximity sensors. In an embodiment of the present invention, the multiple sensors such as a sensor 502 may be positioned along the holding member such that the sensors are proximal to the medical image film placed on the display unit of the patient monitoring device. The sensors may identify the presence of the medical image film when the medical image film is placed on the display unit. For example, an IR sensor present in a holding member may include an emitter and a receiver. The emitter emits IR signals. Normally these IR signals reflect when there is no object placed on a display unit and the reflected signals are received by the receiver. When a medical image film is placed on the display unit the IR signals may be blocked or are not reflected. Thus, the receiver does not receive any reflected signals. This creates a voltage difference in the sensor indicating the presence of the medical image film. In an embodiment of the present invention, the presence of medical image film leads to receiving IR signals at different frequencies by the IR sensor. The receiver may receive the reflected IR signals and detects the presence of the medical image film. Once the presence is detected, the sensors send signals to the control unit for activating the light sources. In accordance with embodiments of the present invention, sensors other than IR sensors may use different techniques for detecting the presence of the medical image film on the display unit 102.

In an embodiment of the present invention, the sensors may be capable of identifying the size of the medical image film and position of the medical image film on the display unit. The sensors may send the size and the position information to the control unit. The control unit may then selectively activate one or more light sources from the multiple light sources in proportion to the size of the image in conjunction with the position of the image; hence, only the light sources required to backlight the medical image film as positioned are activated, which may be less than the total number of light sources available to backlight the medical image film. Referring back to FIG. 1, the medical image film may be placed at top right corner of the display unit 102 due to its reduced size. The position and size of the medical image film may be communicated to the control unit. The control unit may activate less than all of the available light sources present in the top right corner for displaying the medical image film. As a result, unnecessary glowing of all available light sources is avoided thereby reducing power consumption and increasing the life of the light sources. In other words, light sources deemed unnecessary based on the size and/or position of a film are not activated.

Figure 6:
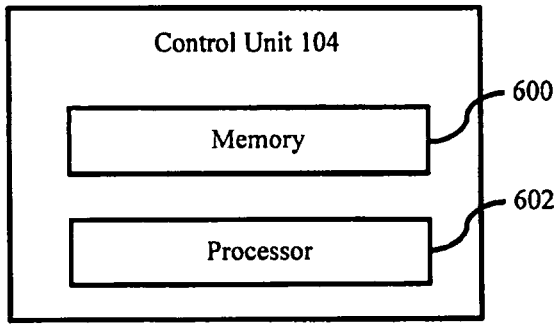
FIG. 6 is a schematic illustration of a control unit for controlling the operation of the patient monitoring device in accordance with an embodiment of the present invention.

FIG. 6 schematically illustrates a control unit 106 for controlling the operation of the patient monitoring device 100 in accordance with an embodiment of the present invention. The control unit 106 comprises a processor 600 and a memory 602. The control unit 106 receives an input upon positioning a medical image film on the display unit 102. In an embodiment of the present invention, the input may be received from the medical expert. In an embodiment of the present invention, the input may be the presence of the medical image film on the display unit 102. A voltage difference may be detected when the medical image film is placed on the display unit 102. The control unit 102 processes this information of change in voltage and detects the presence of the medical image film. This is explained in detail in conjunction with FIG. 3. The processor 600 also receives other information such as size and position of the medical image film placed on the display unit 102. The received information may be stored in the memory 602.

The processor 600 may then perform a check to determine if there are any alarm inputs associated with health condition of the patient. If any alarm inputs are present, the processor 600 does not accept the placement of the medical image film and then the user may be prompted to remove the medical image film. However, if there are no alarm inputs, the processor 600 informs the user that placement of the medical image film is accepted. The processor 600 processes the input and activates multiple light sources necessary to backlight the medical image film for displaying an image present in the medical image film. The processor 600 may selectively activate less than all of the multiple light sources. The light sources to be activated may be selected based on the size of the medical image film and/or the position of the medical image film on the display unit 102. For example, the number of activated light sources may be proportional to the size of the medical image film in conjunction with the position of the film, whereas smaller medical image films will require fewer activated light sources to backlight said films in comparison to larger medical image films and/or light sources deemed unnecessary based on the position of the films are not activated.

When the patient monitoring device 100 is displaying the medical image film, the device is in an image film display mode. In the image film display mode, the light sources are activated to illuminate the display unit to form a white background. The display unit may display the medical image film due to the white background. The patient monitoring device 100 is also capable of operating in a monitoring mode. As explained in conjunction with FIG. 1, the patient monitoring device 100 present health parameters associated with the patient indicating the health condition of the patient. The processor 600 is configured to operate the patient monitoring device 100 in these two modes of the operation.

The patient monitoring device 100 may dynamically shift between the two modes of operation. Shifting between the two modes of operation occurs when an alarm input is received. The processor 600 receives the alarm input associated with the health parameters of the patient. The alarm input may indicate a variation in parameter value of a health parameter such as pulse rate of the patient. The processor 600 may automatically shift the patient monitoring device 100 from the image film display mode to the monitoring mode. In the monitoring mode, the patient monitoring device 100 displays parameter values and waveforms associated with the health parameters. The process of shifting the modes of operation of the patient monitoring device 100 is explained in conjunction with FIG. 2.

Figure 7:
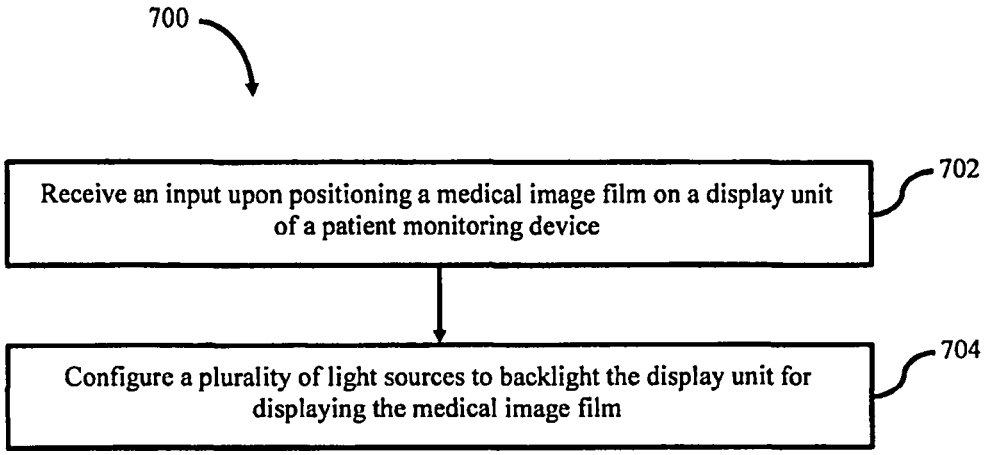
FIG. 7 is a flowchart of a method for displaying a medical image film on a display unit of a patient monitoring device in accordance with an embodiment of the present invention.

FIG. 7 illustrates a flowchart of a method 700 for displaying a medical image film on a display unit of a patient monitoring device in accordance with an embodiment of the present invention. At step 702, an input is received upon positioning a medical image film on a display unit of a patient monitoring device. The input may be a manual input received from a medical expert. The manual input may be submitted by pressing a switch in the patient monitoring device. In an embodiment of the present invention, the input may be received automatically indicating the presence of the medical image film on the display unit.

In addition to the presence information, other information such as the size and the position of the medical image film on the display unit may also be received. This information may be manually entered by the medical expert. In another instance the size and the position of the medical image may be identified automatically using sensors present in the patient monitoring device. In response to receiving the presence information and other information, multiple light sources are configured to backlight the display unit for displaying the medical image film at step 704. In this embodiment, the patient monitoring device may be operating in the image film display mode. The multiple light sources when activated provide a white background through the display unit. As a result, an image present in the medical image film is visible on the display unit. In an embodiment of the present invention, one or more light sources of the multiple light sources may be selectively activated based on the size and the position of the medical image film on the display unit. For example, a medical image film may be placed at a top right corner of the display unit. Depending on its size and/or position, fewer than all light sources present in the top right corner may be activated for displaying the medical image film. As a result, unnecessary activation of all available light sources is avoided and this reduces power consumption and increases the life of the light sources.

The patient monitoring device may shift to operate in the monitoring mode anytime based on an input from the medical expert. The medical expert may remove the medical image film from the display unit and switch the patient monitoring device to the monitoring mode by pressing the switch. In an embodiment of the present invention, once the patient monitoring device receives an alarm input related to health parameters associated with the patient, the patient monitoring device commences operating in the monitoring mode. For instance, an alarm input may pertain to a variation in heart rate of the patient. This variation in the heart rate may be critical because the heart rate may have gone above a threshold value. Thus, when the heart rate goes above the threshold value the alarm input may be generated. A notification may be presented in the display unit indicating the medical expert to switch the patient monitoring device to the monitoring mode. Once switched, the medical expert can perform the necessary actions for bringing the patient to a stable condition. In an embodiment of the present invention, the patient monitoring device may automatically shift to the monitoring mode upon receiving the alarm input.

The method 700 can be performed using a computer, processor or any other processing device. The method steps can be implemented using coded instructions (e.g., computer readable instructions) stored on a tangible computer readable medium and in some embodiments non-transitory, tangible computer readable storage medium. The computer readable medium may be for example a flash memory, a read-only memory (ROM), a random access memory (RAM), any other computer readable storage medium and any storage media. Although the method of displaying a medical image film on a display unit of a patient monitoring device are explained with reference to the flow chart of FIG. 7, other methods of implementing the method can be employed. For example, the order of execution of each method step may be changed, and/or some of the method steps described may be changed, eliminated, divided or combined. Further, the method steps may be sequentially or simultaneously executed for displaying a medical image films on a display unit of a patient monitoring device.

This written description uses examples to disclose the invention, including the best mode, and also to enable any person skilled in the art to practice the invention, including making and using any computing system or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A patient monitoring device comprising:

a display unit comprising a plurality of light sources, wherein the plurality of light sources is configured to backlight a medical image film of a patient placed on the display unit for viewing the medical image film; and a control unit coupled to the display unit and configured to activate the plurality of light sources based on a user input, wherein the patient monitoring device is configured to operate in at least two modes shifted by the control unit, the at least two modes comprising:

an image film display mode, wherein in the image film display mode, the plurality of light sources is configured to illuminate the display unit to form a white background for displaying the medical image film; and a monitoring mode, wherein in the monitoring mode, the display unit is configured to display at least one health parameter of the patient.

2. The patient monitoring device of claim 1, wherein the patient monitoring device is further configured to automatically shift from the image film display mode to the monitoring mode based on an alarm input associated with the at least one health parameter of the patient.

3. The patient monitoring device of claim 1, further comprising at least one holding unit connected to the display unit, wherein the at least one holding unit is configured to hold the medical image film on the display unit.

4. The patient monitoring device of claim 3, further comprising:

at least one sensor mounted on a holding unit of the at least one holding unit, wherein the at least one sensor is configured to identify at least one of:

a presence of the medical image film on the display unit, a size of the medical image film, and a position of the medical image film on the display unit.

5. The patient monitoring device of claim 4, wherein:

the control unit is further configured to communicate with the at least one sensor, and to selectively activate at least one light source of the plurality of light sources based on at least one of the size of the medical image film, and the position of the medical image film on the display unit.

6. A control unit for operating a patient monitoring device, wherein the patient monitoring device is configured to display at least one health parameter of a patient, the control unit comprising:

a processor configured to:

receive an input upon positioning a medical image film on a display unit of the patient monitoring device, and activate a plurality of light sources configured to backlight the medical image film on the display unit for viewing the medical image film in response to receiving the input.

7. The control unit of claim 6, wherein the input comprises at least one of a user input and an input corresponding to a presence of the medical image film on the display unit.

8. The control unit of claim 6, wherein the processor is further configured to operate the patient monitoring device in at least two modes, the at least two modes comprising:

an image film display mode, wherein in the image film display mode, the plurality of light sources is configured to illuminate the display unit to form a white background for displaying the medical image film; and a monitoring mode, wherein in the monitoring mode, the display unit is configured to present the at least one health parameter of the patient.

9. The control unit of claim 8, wherein the processor is further configured to automatically shift the patient monitoring device from the image film display mode to the monitoring mode based on an alarm input associated with the at least one health parameter of the patient.

10. The control unit of claim 6, wherein the processor is further configured to receive information associated with at least one of:

the presence of the medical image film on the display unit, a size of the medical image film, and a position of the medical image film on the display unit.

11. The control unit of claim 10, wherein the processor is further configured to selectively activate at least one light source of the plurality of light sources based on at least one of the size of the medical image film and the position of the medical image film on the display unit.

12. A method of displaying a medical image film of a patient on a display unit of a patient monitoring device, wherein the patient monitoring device is configured to operate in at least two modes shifted by a control unit, the at least two modes comprising (i) an image film display mode and (ii) a monitoring mode, wherein in the monitoring mode, the display unit is configured to display at least one health parameter of the patient, the method comprising:

receiving, in the image film display mode, an input upon positioning a medical image film on the display unit of the patient monitoring device; and activating a plurality of light sources configured to backlight the medical image film placed on the display unit for displaying the medical image film in response to receiving the input.

13. The method of claim 12 further comprising receiving information associated with at least one of:

the presence of the medical image film on the display unit, a size of the medical image film, and a position of the medical image film on the display unit.

14. The method of claim 13, wherein activating the plurality of light sources comprises selectively activating at least one light source based on at least one of the size of the medical image film, and the position of the medical image film on the display unit.

15. The method of claim 13, wherein receiving an input comprises receiving at least one of a user input and an input corresponding to a presence of the medical image film on the display unit.

* * * * *